US005636785A

United States Patent [19]

Kalberer et al.

[11] Patent Number: 5,636,785

[45] Date of Patent: Jun. 10, 1997

[54] GABLE TOP CONTAINER

[75] Inventors: Roderick W. Kalberer, Salisbury Mills, N.Y.; Clarence R. Thompson, Cedar Rapids, Iowa; Patrick J. Smith, Cordova, Tenn.

[73] Assignee: International Paper, Purchase, N.Y.

[21] Appl. No.: 637,059

[22] Filed: Apr. 24, 1996

[51] Int. Cl.[6] ..... B65D 5/08; B65D 5/40

[52] U.S. Cl. ..... 229/137; 229/125.15; 229/125.42

[58] Field of Search ..... 229/125.14, 125.15, 229/125.42, 137, 138

[56] References Cited

U.S. PATENT DOCUMENTS

| | | | |
|---|---|---|---|
| 1,924,529 | 8/1933 | Wellman . | |
| 2,321,139 | 6/1943 | Gruger . | |
| 4,192,446 | 3/1980 | Naito . | |
| 4,691,858 | 9/1987 | Peer, Jr. . | |
| 4,702,410 | 10/1987 | Derving . | |
| 4,728,024 | 3/1988 | Farber . | |
| 4,730,766 | 3/1988 | Fear | 229/137 |
| 4,754,917 | 7/1988 | Gordon . | |
| 4,785,993 | 11/1988 | Lisiecki . | |
| 4,801,073 | 1/1989 | Farber . | |
| 4,819,865 | 4/1989 | Lisiecki . | |
| 5,088,643 | 2/1992 | Frazier et al. | 229/125.15 |

FOREIGN PATENT DOCUMENTS

| | | | |
|---|---|---|---|
| 2099402 | 12/1982 | United Kingdom | 229/137 |

*Primary Examiner*—Gary E. Elkins
*Attorney, Agent, or Firm*—Michael J. Doyle

[57] ABSTRACT

A gable top type paperboard carton for juices and other pourable product which may attack the integrity of seals is formed with a pour spout fitment attached to one of the two sloping roof panels. The carton is formed so as to exhibit a rectangular cross section transverse to its longitudinal (vertical) axis, to thereby yield a gable top whose sloping roof panels extend upwardly from the narrower carton side walls. In use, the consumer grasps the two widest side walls of the carton by the thumb and one or more other fingers. This is in distinction to grasping the narrower carton sides, which would entail a wider finger grasp or span. The carton includes a V pocket forming panel in a first gusset, the V pocket receiving a V forming point or wedge on the second gusset. A similar V forming pocket and V point may be located on opposite bottom closure panels. Either V forming pocket may be of paperboard or of barrier film. This construction overcomes the problem of abutting tips of opposite gussets which arises when the gussets are necessarily moved towards each other to form longer sloping roof panels, so as to accept a larger diameter pour spout.

10 Claims, 3 Drawing Sheets

GABLE TOP CONTAINER

BACKGROUND OF THE INVENTION

This invention relates to paperboard containers and more particularly to a gable top container of the type extensively used for the packaging of milk, fruit juice, and other pourable product. The tops of such containers include a vertical and uppermost fin which joins the upper edges of two slanting roof panels. An infolded gusset panel is beneath each of the two fin ends. To initially open the carton for dispensing, the consumer spreads apart the slanting roof panels at one of their two respective ends to open one of the gussets to thereby form a pour spout which extends outwardly. After partial dispensing, the gusset spout is refolded back into the carton. The containers have in the past been square in transverse cross section and have recently been provided with a pour spout on one of the two top slanting roof panels.

In an attempt to improve ease in holding the carton and pouring, one side dimension has been reduced by one manufacturer so as to make the carton easier to grasp. Namely, a rectangular (two opposite sides longer than the other two opposite sides) instead of a square cross section has been produced. However, the infolded gusset panels are on the narrow sidewalls. If a pour spout were placed on the upper part of such a narrowed container, it would be placed on one of those two slanting roof panels which extends upwardly from the two widest side walls. The available space for placing a spout on either of the two slanting roof panels is dictated by the slant roof panel distance from the upstanding vertical fin to the top of the corresponding vertical side wall. Such a carton would be somewhat awkward to use, since the user would ordinarily grasp the carton between the thumb and the fingers, the latter placed on the widest sides and would have to pour sideways from the carton.

SUMMARY OF THE INVENTION

According to the practice of this invention, a gable top carton having a pour spout fitment is formed to exhibit a rectangular transverse section, and the gusset panels which lie beneath the slanting top panels are extensions from the widest, and not the narrowest, pair of sidewall panels. By this construction the slanting roof panels are of their maximum length to thereby permit the largest possible diameter pour spout fitment to be attached to one of these roof panels, while allowing the consumer to grasp the carton across the narrowest part of the container.

If one started with a square carton and made it rectangular so as to provide longer sloping roof panels to thus accept a larger diameter pour spout, one would encounter the problem of abutting or overlapping tips or upper ends of the oppositely positioned infolded gusset panels, since these gusset panels would now be closer to each other than in a square carton. By this invention, the problem of abutting or overlapping upper tips or ends of the gusset panels is solved by the use of a V to V configuration at the tips or ends of the gusset panels. Namely, one gusset panel upper end is configured so as to be foldable into a V pocket, this V pocket accepting a V abutment or male V point formed on the opposite gusset panel. This space saving arrangement permits one, in a readily carried out manner, to form a rectangular carton which is thus easier to grasp and pour from, and which has the longest possible length of the roof panels to accept the largest possible diameter pour spout.

The two top edges of opposite gusset forming sidewall panels are provided with local peaks rising above the remaining top edges to maintain their central portions level upon folding the opposite gusset panels inwardly into a V-to-V abutting relationship. The fold lines of the V forming upper gusset pocket are either scored and cut or cut only to facilitate their bending upon folding and forming the carton. The bottom closure also includes infolded gussets, similarly formed but not peaked at their center. The carton is formed from a unitary paperboard blank conventionally coated with one or more barrier polymer layers, including polyethylene.

DETAILED DESCRIPTION OF THE INVENTION

Figure 1:
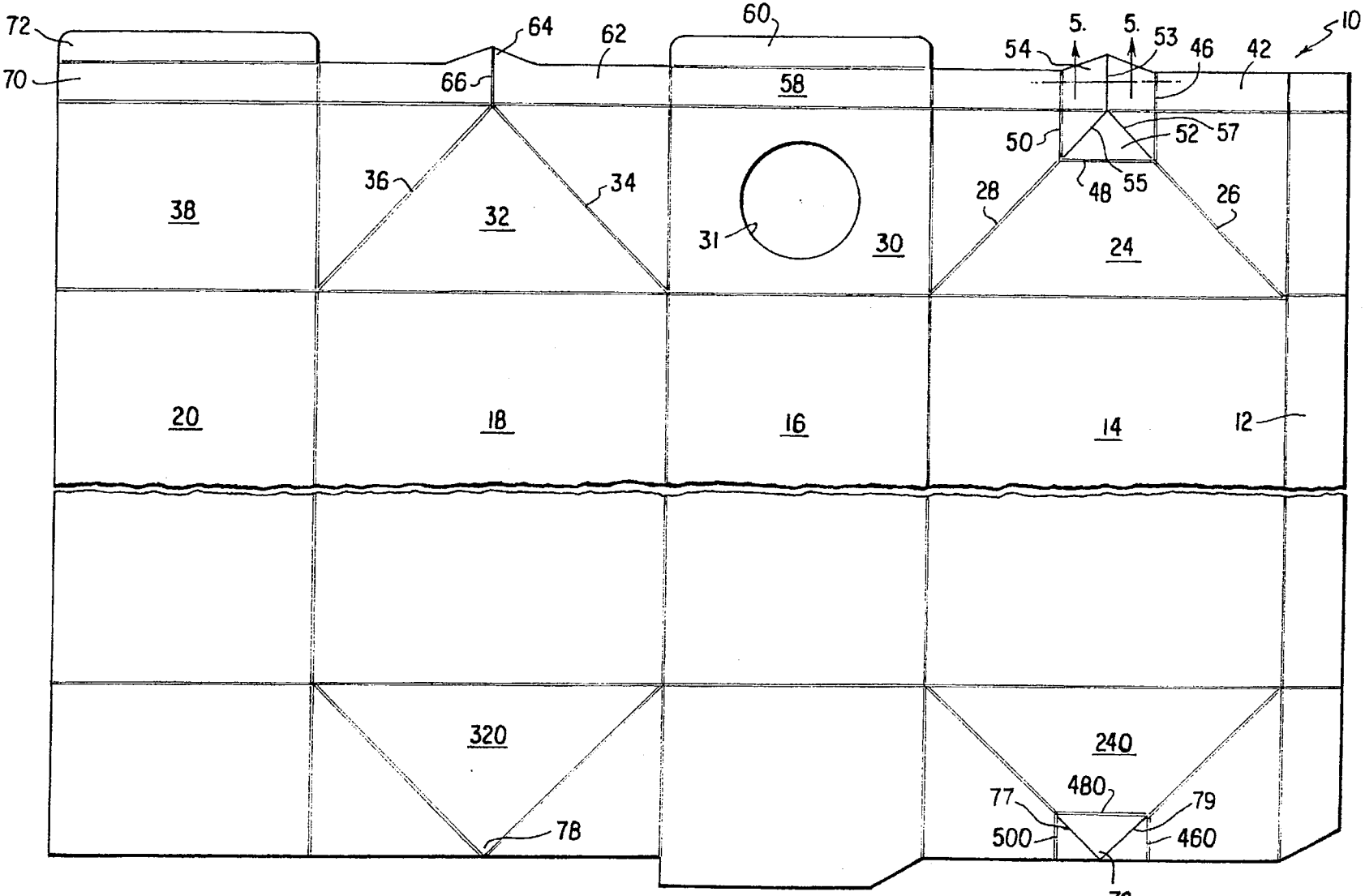
FIG. 1 is a plan view of a unitary blank of paperboard for forming the gable top container of this invention.

Referring now to FIG. 1, a unitary blank of paperboard, typically coated on one or both sides with one or more barrier layers, including a thermoplastic outer layer, is illustrated. The blank includes four serially arranged panels 14, 16, 18, and 20, with panel 12 being a so-called manufacturer's flap or side seam which enables the four main panels to form a rectangular tube. A first gusset panel 24 having slanted score lines 26 and 28 is positioned above first side wall panel 14. A first slanting roof panel 30, having an aperture 31, is positioned above second side wall panel 16. A second gusset panel 32, having slanted score or fold lines 34 and 36 is positioned above third side wall panel 18. A second slanting roof panel 38 is positioned above fourth side wall forming panel 20. A first upper sealing panel 42 is positioned above gusset forming panel 24. Also included at the upper end of panel 14 is a vertical score line 46, a horizontal score line 48 and a vertical score line 50, with these score lines defining, with the indicated free edge of panel 42, a generally rectangular V pocket forming panel 54. Panel 54 is slightly raised or peaked at the upper, free edge of panel 42. Line 53 extends vertically upwardly from the intersection of lines 55 and 57, line 53 extending to the free edge of panel 54. The peak of V pocket forming panel 54 extends above the remainder of the free edge of panel 42. It is seen that lines 53, 55, and 57 form an inverted Y.

Lower fin forming panels 42, 58, 62, and 70 are longitudinally serially joined and form, as will soon be seen, a lower portion of the usual vertical fin of the gable top carton. Upper fin panels 60 and 72 form, as will soon be seen, the uppermost part of the usual vertical fin of the gable top carton.

Panel 62 is horizontally aligned with panel 58, the latter horizontally aligned with panel 42, with the midpoint of panel 62 including a V forming extension or peak 64, similar to V extension 54 of panel 42. The midpoint of peak 64 is provided with a vertical score line 66. Panel 70 is horizontally aligned with panel 62, with panel 70 being above the second slanting roof forming top closure forming panel 38. Panel 60 is above panel 58, while panel 72 is above panel 70. These panels, as well as other panels described, are formed by the indicated fold lines, not all of which bear reference numerals.

The bottom closure forming portion of blank 10 includes at the bottom of panel 14 a lower gusset panel 240, similar to panel 24, and having the indicated slanted and intersecting score lines. A lower panel 76, adapted to form a V pocket, is defined by vertically extending score lines 460 and 500 and a horizontally extending score line 480, similar to score lines 46, 48 and 50 of upper gusset panel 24. The tip of panel 76 is formed by the intersection of slanted lines 77 and 79, identical in structure to lines 55 and 57. Lower gusset forming panel 320 is also used for the bottom closure and is similar to gusset panel 32, with the former including a tip 78 for forming a V point. Side panels 16 and 20 are narrower in width than side wall panels 14 and 18.

Figure 2:
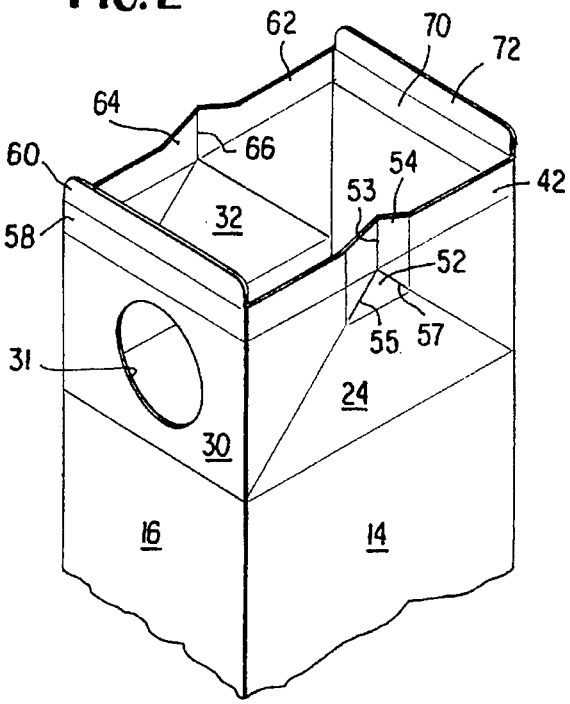
FIG. 2 is a view illustrating the top of a container fashioned from the blank of FIG. 1 after it has been heat sealed and set up to form a tube.

FIG. 2 illustrates the blank of FIG. 1 after it has been folded into a rectangular tube configuration by heat sealing panel 12 to an opposite portion of side wall forming panel 20 and roof panel 28 and the bottom left (unnumbered) bottom closure panel. FIG. 2 shows oppositely facing gusset forming panels 24 and 32, with upstanding local peaks 54 and 64 from respective edges of panels 42 and 62. Oppositely pointed arrows shown at FIGS. 2 and 3 indicate the direction in which the slanted roof panels are pushed towards each other to form the gable top closure.

Figure 3:
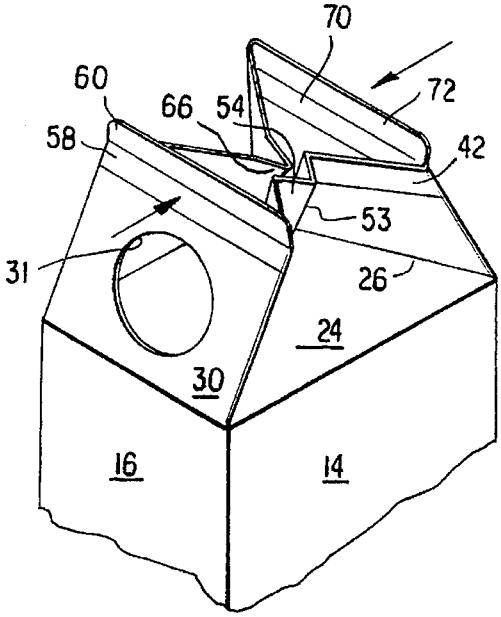
FIG. 3 is a view similar to FIG. 2 and illustrates an intermediate stage or configuration in the formation of the carton prior to final sealing.

Referring now to FIG. 3, the upper roof panels have been pushed together to an extent to thereby cause inward bending of gusset panels 24 and 32 with the respective 45° slanted score lines 26, 28, 34, and 36. By virtue of cut 53 extending partially through paperboard blank 10, as shown at FIG. 5, bending of panel 54 is facilitated to form a generally V shaped pocket. As shown at FIG. 5A line 53 may be both scored and cut. Lines 55 and 57 may also be either cut only, or scored and cut. Fold line 66 of peak 64, scored only, forms a V point or abutment tongue to fit into the pocket of the V formed from panel 54. With continued closing of the upper portion of the carton shown at FIG. 3, the carton finally reaches the configuration of FIG. 4, with the conventional gable carton vertical top fin including sealed together upper fin panels 60 and 72 at the upper ends of slanting roof panels 30 and 38. The tips of the gussets, which include the V abutment to V pocket arrangement, are sandwiched between lower fin forming panels 58 and 70 (the latter beneath panels 60 and 72), with these tips and panels also sealed flat by heat and pressure to assume a vertical position. Panels 60 and 72 are termed upper fin forming panels, while panels 58 and 70 are termed lower fin forming panels. Panels 42 and 62 are also lower fin forming panels, being sandwiched by lower fin forming panels 58 and 70. A conventional and typically plastic pour spout fitment having a cap 84 and flange 86 is illustrated. In practice the pour spout fitment may be applied to the outside of the carton over and aligned with opening 31, with flange 86 on the outside, or may be applied from the carton interior through opening 31, with flange 86 on the inside.

Figure 4:
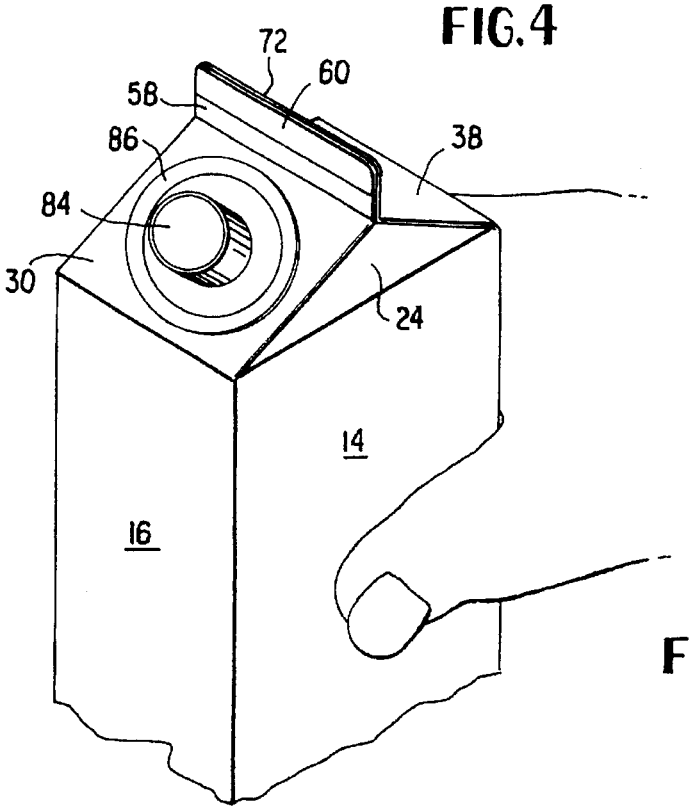
FIG. 4 illustrates the completed gable top container of this invention, provided with a pour spout, and being held by a user immediately prior to an initial or immediate dispensing of the contents.
Figure 5:
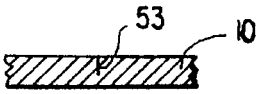
FIG. 5 is as view taken along section 5—5 of FIG. 1.
Figure 5A:
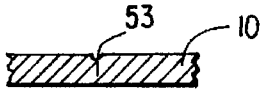
FIG. 5A is similar to FIG. 5, and shows a modification.

FIG. 4 illustrates a hand as grasping the larger area side walls 14 and 18 of the carton, the hand thus spanning a smaller distance than if opposite side wall panels 16 and 20 were grasped.

Figure 6:
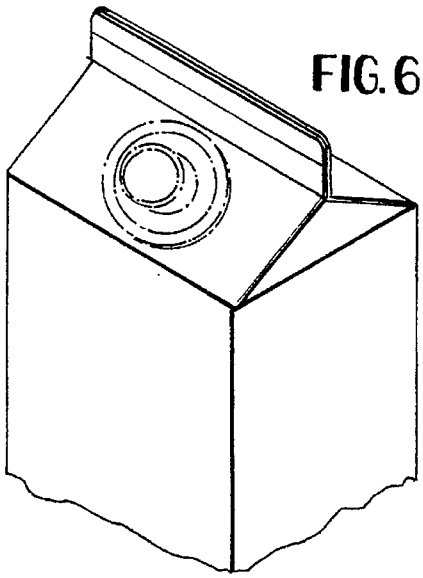
FIG. 6 is a perspective view of a prior art gable top carton which is of a rectangular (non-square) transverse cross section, with the dashed lines indicating the location of a pour spout.

Referring now to FIG. 6, a prior art gable top carton of rectangular (nonsquare) transverse cross section is illustrated and the reader will observe that the infolded gusset panels extend from the narrower width side walls of the carton. If a pour spout was added to one of the sloping roof panels of this carton, the spout would necessarily be located as shown by the dashed lines. To pour from this carton, the consumer must either grasp the narrow sides (requiring a wider grasp) or must grasp the wider sides and pour sideways. It is seen that the slant length of the roof panel of FIG. 4 which receives the pour spout is greater than the slant length of the roof panel of FIG. 6 which receives the pour spout, thus enabling the use of a larger diameter spout. A comparison of these two Figures demonstrates that in passing or changing from the FIG. 6 rectangular transverse cross section configuration to a square configuration (not shown) and then to the final FIG. 4 rectangular configuration, the infolded, opposite gussets move nearer to each other as the length of the sloping roof panels increases, along with a decrease in the length of the gable top fin. In the rectangular configuration of FIG. 6, the tops of the infolded gussets are separated. In a square gable top container configuration, the tops of the infolded gussets are close to but never touch each other. In the FIG. 4 rectangular configuration, the V abutment to V pocket arrangement shown at FIGS. 3, 8, and 9 accommodates and fixedly positions the abutting gusset tops or tips.

Figure 7:
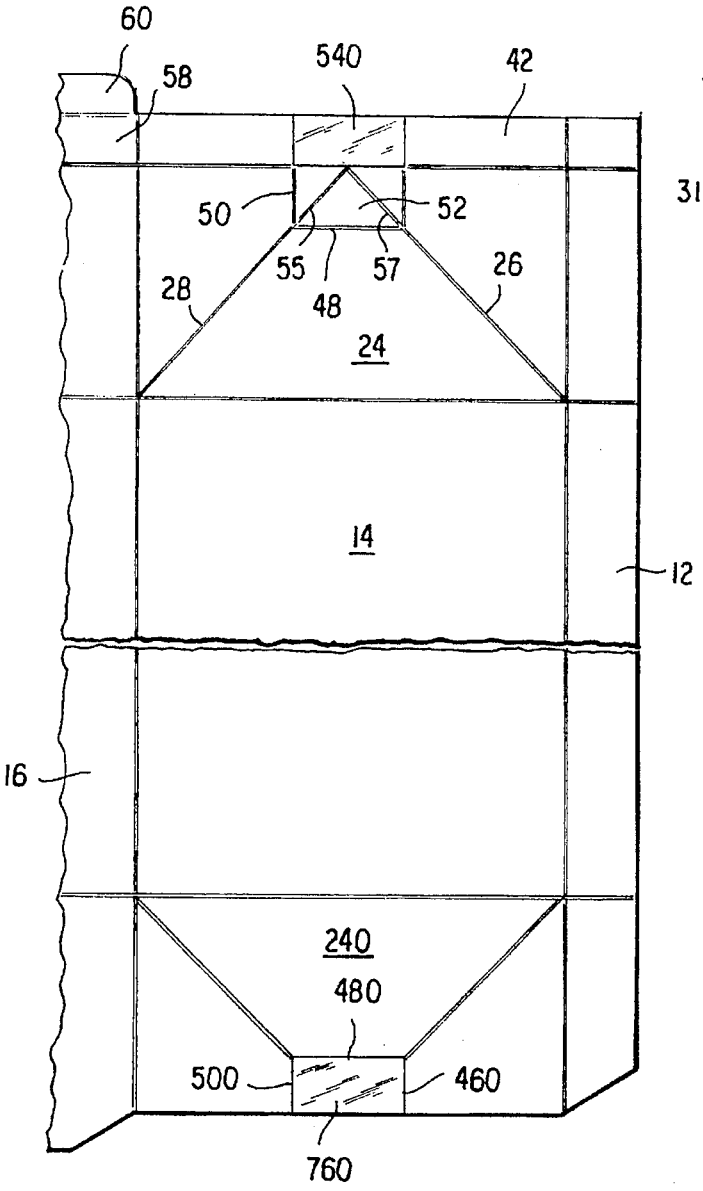
FIG. 7 is a partial plan view, similar to FIG. 1, of a modification.

Referring now to FIG. 7, a blank is shown which is the same as that of FIG. 1, except for the different construction of first panel 14 of FIG. 1. V pocket forming panel 54 is replaced by a web 540 formed of the barrier layer coatings on both surfaces of the blank, identical to the barrier coatings on the blank of FIG. 1. Web 540 is similar to flexible layer 32 of the construction shown in U.S. Pat. 4,754,917 issued to Robert L. Gordon et al. Panel 540 spans a gap defined by the effective removal of panel 54 and thus extends between vertical fold lines 46 and 50 of FIG. 1 and above the horizontal continuous fold line at the top of the blank of FIG. 1. Similarly, flexible barrier layer panel 760 at the bottom of the blank of FIG. 7 replaces panel 76 of FIG. 1 between vertical fold lines 460 and 500 and below fold line 480 of FIG. 1.

Figure 8:
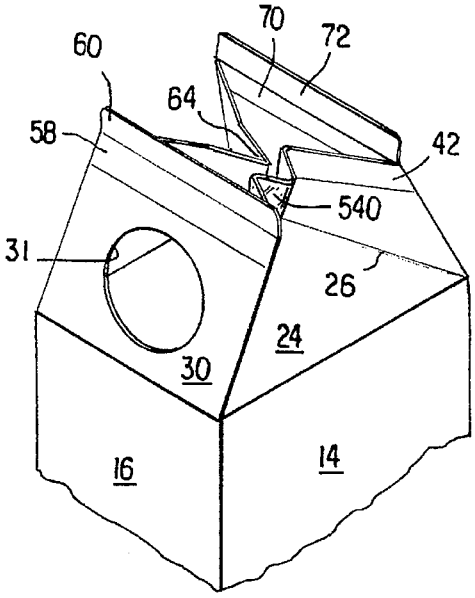
FIG. 8 is a partial perspective view, similar to FIG. 3, illustrating the carton top of the modification of FIG. 7.
Figure 9:
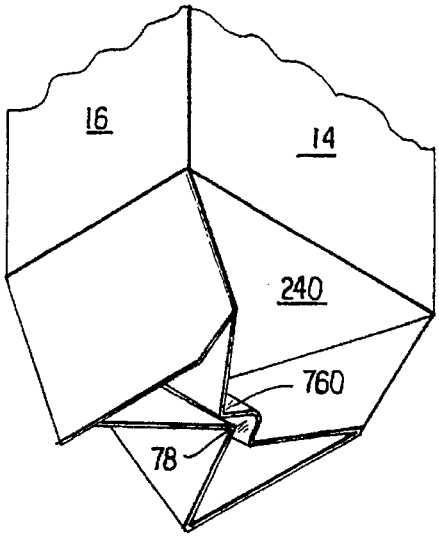
FIG. 9 is a partial perspective view of the carton bottom of the modification of FIG. 7.

At FIG. 8, the blank of FIG. 7 has been folded and heat sealed to form a tube similar that manner described regarding the formation of the tube of FIGS. 2 and 3. The upper carton gable type closure is formed in a manner similar to that shown at FIG. 3, except that instead of bearing against V pocket forming paperboard panel 54 upon inward folding of the gusset panels 24 and 32, V forming panel portion 64 bears against flexible web 540 to deform the latter to a V shape. Lines 55 and 57 are of the same construction as earlier set forth. Upper fins 60 and 62 are thereafter moved together and heat sealed to form the completed gable type top, similar to the action shown at FIGS. 3 and 4. The bottom of the tube is closed flat by moving bottom gusset panels 240 and 320 together, causing gusset tip 78 to bear against and deform flexible web 760 into a V shape as shown at FIG. 9. Continued folding of the bottom closure panels causes them to form a flat bottom, sealed with heat and pressure, sealing these closure panels by partial melting of the plastic barrier layer coatings thereon, as is conventional in the formation of flat paperboard carton ends. V wedge or male abutment 78, in both FIGS. 1 and 9, is tucked into the V pocket formed by either 76 of FIG. 1 or 760 of FIG. 9. The formation of the bottom closure of the carton formed from the blank of FIG. 1 is the same as that illustrated at FIG. 9, except that, in the former, paperboard forms the V pocket for V tip 78.

FIG. 5 shows score line 53 as extending about halfway through the paperboard to thus facilitate the deformation of panel 54 by V abutment tongue 64. In the modification of FIG. 5A, both a score line and a cut line are used. As noted above, either form may be employed for lines 53, 55, and 57.

We claim:

1. A gable top type carton formed of a unitary paperboard blank, said carton including a gable top having a pair of oppositely disposed slanted roof panels and an upstanding vertical fin, said carton being rectangular in transverse cross section to thereby present a first pair of opposite side walls of a first width and a second pair of opposite side walls of a second and greater width, said slanted roof panels extending upwardly from respective side walls of said first width, a pour opening aligned with a pour spout, said pour opening and pour spout located on one of said slanting roof panels of said first width, said gable top having oppositely disposed infolded gusset panels each of which gusset panels has a tip, a first one of said gusset tips defining a V abutment wedge, a second of said gusset tips having a V pocket which pocket receives said V abutment wedge, said V abutment wedge and V pocket being flattened and being sandwiched by portions of said upstanding fin, each of said infolded gusset panels which extends upwardly from those respective said opposite side walls having said greater width.

2. The carton of claim 1 wherein said carton is coated with a plastic barrier layer material, and wherein said V pocket is formed from said barrier layer material.

3. The carton of claim 1 wherein said V pocket has a trough and wherein said trough is provided with a coextensive cut extending at least partially through said blank to facilitate formation of said V pocket.

4. The carton of claim 1 wherein said upstanding vertical fin includes two opposite and uppermost fin panels in coextensive surface contact with each other.

5. the carton of claim 4 wherein said upstanding vertical fin also includes two lowermost fin panels attached to respective said two uppermost fin panels, said two lowermost fin panels connected to respective said slanting roof panels, said two lowermost fin panels sandwiching said flattened V abutment wedge and V pocket.

6. The blank of claim 1 wherein said fin forming panels of said second and fourth top end closure panels are lower fin forming panels, each of the latter joined to a respective upper fin forming panel.

7. A carton blank formed from a unitary blank of stiff, resilient and foldable sheet material, the blank adapted to be folded to form a tube and adapted to contain a pourable product, the blank including first, second, third, and fourth parallel and generally rectangular side wall forming panels serially side by side foldably joined together and each having a top end closure panel, said first and third side wall forming panels being of the same width, said second and fourth side wall forming panels being of the same width, said first and third side wall forming panels being wider than said second and fourth side wall forming panels, each said top end closure panel being generally rectangular, said top end closure panels being foldably joined to each other and having at an upper end of each a respective fin forming panel, said fin forming panels of said first and third side wall panels each having a free edge, said first and third top end closure panels each having a pair of intersecting fold lines to form a respective infolded gusset panel, said fin forming panel of said first top end closure panel having a deformable V pocket forming panel midway of its free edge, said fin forming panel of said third top end closure panel having a V forming abutment tongue forming portion midway of its free edge.

8. The blank of claim 7 wherein said deformable V pocket forming panel is formed of a barrier layer material coated on said blank.

9. The blank of claim 7 wherein said V forming abutment tongue portion is provided with a vertically extending score line to facilitate its deformation into a V abutment tongue.

10. The blank of claim including a pour opening on said second top closure panel.

* * * * *